United States Patent [19]

Martin et al.

[11] Patent Number: 4,899,798

[45] Date of Patent: Feb. 13, 1990

[54] METHOD OF AND APPARATUS FOR RECOVERING AND REUSING ORGANIC PICKLING VAPORS

[75] Inventors: Ronald R. Martin; Vernon J. Miller, Sr., both of Carrollton, Ga.

[73] Assignee: Southwire Company, Carrollton, Ga.

[21] Appl. No.: 276,756

[22] Filed: Nov. 28, 1988

[51] Int. Cl.[4] ..... B22D 11/12

[52] U.S. Cl. ..... 164/5; 164/417; 164/476; 164/477; 134/12; 134/15; 148/13.2; 148/20.3

[58] Field of Search ..... 164/5, 417, 476, 477; 134/12, 15, 29; 148/13.2, 20.3

[56] References Cited

U.S. PATENT DOCUMENTS

| | | | |
|---|---|---|---|
| 3,806,366 | 4/1974 | Cofer et al. | 134/15 |
| 4,622,039 | 11/1986 | Merenda | 134/12 |
| 4,754,803 | 7/1988 | Escobar, Jr. et al. | 164/477 |

*Primary Examiner*—Richard K. Seidel
*Attorney, Agent, or Firm*—Stanley L. Tate

[57] ABSTRACT

Method of and apparatus for continuously reducing oxides which form on the surface of copper bar and rod during casting including means for collecting cleaning mixture vapors; means for raising the temperature and pressure of the collected vapor; means for lowering the temperature of the collected vapor below the temperature at which the vapor will condense without lowering the system pressure; and means for separating condensed cleaning mixture from uncondensed vapor as the uncondensed vapor is being conveyed to a furnace or other means for oxidizing residual vapor.

7 Claims, 1 Drawing Sheet

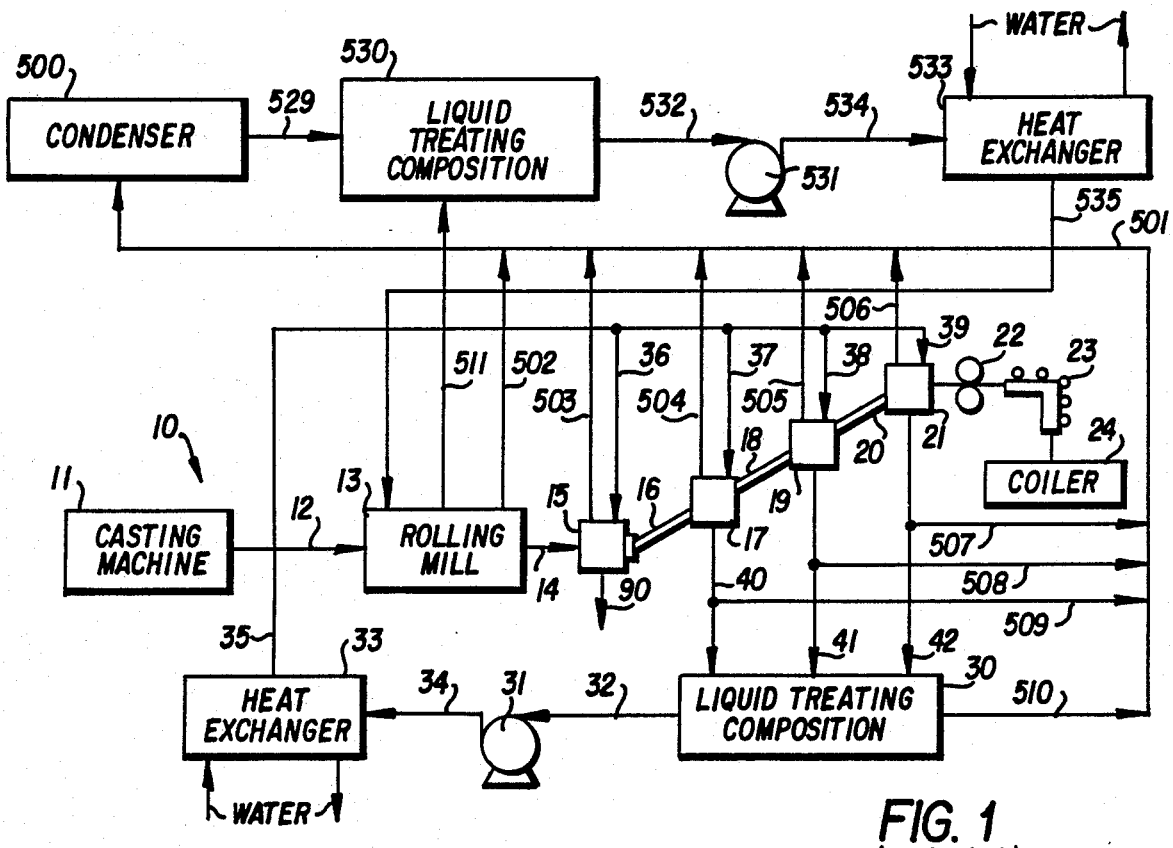
FIG. 1
(PRIOR ART)
FIG. 2
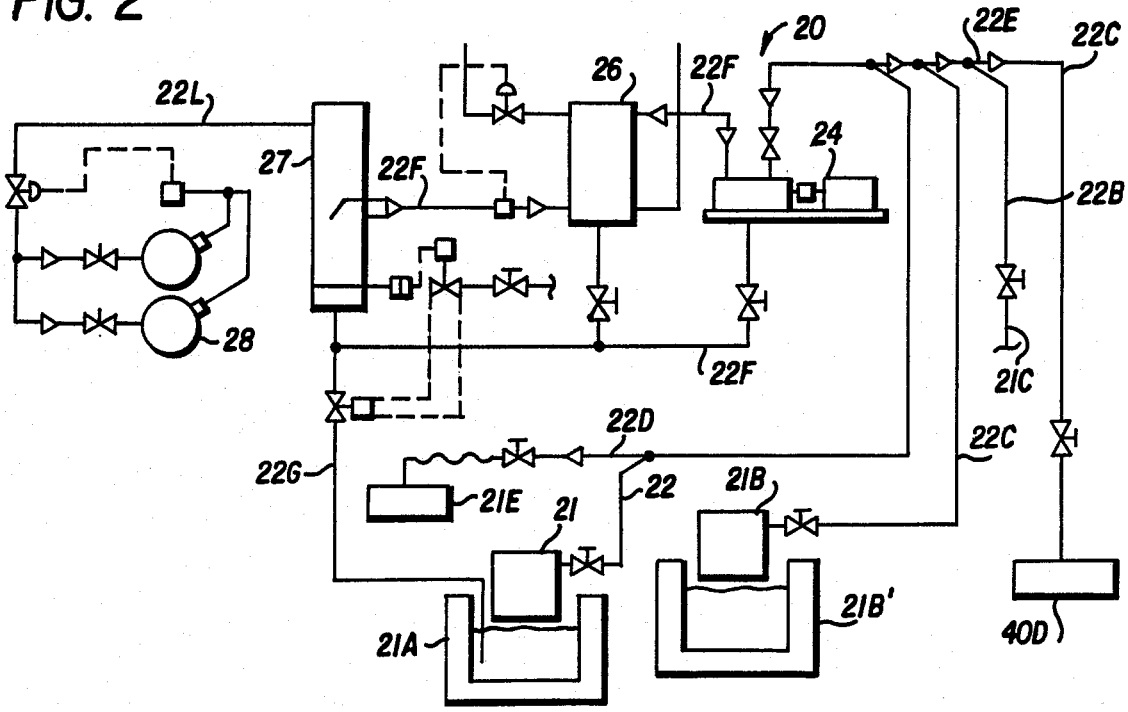

METHOD OF AND APPARATUS FOR RECOVERING AND REUSING ORGANIC PICKLING VAPORS

TECHNICAL FIELD

This invention relates to improved method and apparatus for pickling continuously cast copper. More particularly, this invention is directed to controlled cooling and cleaning of cast bar and rod and the recovery and reuse of organic vapors produced during the rolling of the cast bar into rod and during removal of surface oxides which form on the bar and rod during casting and rolling.

BACKGROUND ART

In the manufacture of continuous cast copper, the copper leaving the casting apparatus is generally immediately hot rolled. When exposed to the atmosphere, the copper oxidizes and accumulates surface scale which consists of a mixture of cuprous (red) and cupric (black) oxides. It must be removed or reduced to its metallic state before the copper can be drawn into commercially acceptable wire because oxides on the rod surface cause premature wear of the drawing dies and other production problems. Additionally oxide inclusions in rod may cause breaks in the rod during the drawing process.

Heretofore, different approaches have been suggested for removing the oxide scale from the surface of copper-based products. It should be mentioned that the term "copper" as used herein is meant to also include copper alloys. Exemplary of the approaches suggested for descaling are: (1) mechanically removing the scale as by sanding, shaving or the like, (2) acid cleaning (or pickling), (3) vapor reduction; and (4) non-acid cleaning or reduction.

For example, U.S. Pat. No. 3,623,532, which issued on Nov. 30, 1971 to Chia, et al. and assigned to the assignees of the present invention, discloses a system whereby acid pickling is used for descaling copper rod by immersing the rod in a dilute aqueous acid solution, e.g., sulfuric acid, citric acid, after the cast rod leaves the rolling mill but before it reaches the coiler. This pickling process utilizes the heat contained in the rod to speed up the chemical reaction which results in the reduction of oxides on the surface of the rod. Under these conditions the copper oxides are removed from the surface by the combination of a physical-chemical process; that is, by breaking the scale because the differences in thermal contraction of the oxides and the copper substrate, causes the oxide to shatter and fall away from the rod; by dissolving the oxides which are soluble in an acid; and by chemically reducing the oxides. Usually, in less than one second, the rod has to be cleaned and cooled from a temperature of about 1000 degrees F. to about ambient temperature. The used acid is then returned in the tank and pumped through a heat exchanger and back to the injectors where it is again applied to rod being cooled and cleaned. To maintain optimal cleaning conditions, the cleaning solution is continually regenerated to maintain the copper content and the acid concentration at a predetermined level. This is accomplished by passing the used solution through an electroplating unit and periodically adding new acid to the system.

The foregoing disclosed pickling process has been used with great success by the assignee of the present invention. However, in an effort to reduce operating costs necessitated by the use of acid resistant materials, to avoid ecological problems associated with waste acid disposal, and to produce a more consistent and better quality product, an alternative approach to acid pickling has been developed.

Other techniques which employ one or more reducing gases or vapors to treat oxidized copper rod are disclosed in U.S. Pat. Nos. 3,546,029; 3,562,025; 3,620,853; and 3,659,830, all issued in the name of C. J. Snyder or C. J. Snyder and others, and assigned to Anaconda Wire and Cable Company. In these patents, it is stated that oxide scale is removed by first exposing the rod to high temperature reducing gases or vapors and thereafter immediately quenching the rod in a cooling bath prior to exposure to the atmosphere.

Although the gaseous reduction approach appears to have some advantages over acid pickling, certain disadvantages are inherent in such systems. For instance, the gases or vapors which are suitable for reducing copper oxides are flammable and poisonous, or both, and therefore require special handling to avoid explosion, asphyxiation, or the like. Local, state and federal emission regulations require almost total elimination of organic emissions making it mandatory to practice conservation and emission control measures that allow operators to collect and account for organic solvents used in industrial processes such as the oxide reduction process described above. In fact one great disadvantage of prior art oxide reduction methods and apparatus is the inability of the operator to control solvent loss thereby making the operator subject to fines and other sanctions by regulatory agencies which oversee industry compliance with emission standards.

DISCLOSURE OF THE INVENTION

It is therefore a primary object of the present invention to provide an improved method of and apparatus for reducing oxides which form on the surface of continuously cast and rolled copper rod which avoids the limitations of corrosive acid treating solutions as well as eliminates the environmental problems associated with the use of organic reducing agents such as alcohol, aldehydes, ketones and organic acids.

It is another object of the present invention to provide a method of collecting cleaning mixture (reducing agent mixture) vapors and conveying the collecting vapors to a central point for concentration and condensation.

Yet another object of the present invention is to provide a method of altering the dew point of the collected vapors to facilitate the more efficient removal of cleaning mixture from the collected cleaning mixture vapors.

Still another object of the present invention is to provide a method of efficiently condensing liquid cleaning mixture from collected vapor.

Another object of the present invention is to provide a method of collecting condensed cleaning mixture for reuse in a system for removing oxide from the surface of cast copper bar and rod.

A further object of the present invention is to provide a closed system for removing oxide which has formed on the surface of continuously cast copper bar and rod.

Yet another object of the present invention is to provide a method of completely oxidizing residual collected vapor so that no organic vapors are emitted to the atmosphere by the system.

Still another object of the present invention is to provide an improved apparatus for removing oxides which form on the surface on continuously cast and rolled copper rod which avoids the limitation of corrosive acid treating solutions as well as eliminates the environmental problems usually associated with the use of organic reducing agents such as alcohols, aldehydes, ketones and organic acids.

Yet another object of the present invention is to provide apparatus for collecting cleaning mixture vapors and conveying the collected vapors to a central point for concentration and condensation.

It is also an object of the present invention to provide an apparatus for alterting the dew point of the collected cleaning mixture vapors so that cleaning mixture can be efficiently removed from the collected vapors.

Another object of the present invention is to provide an apparatus which will efficiently condense liquid cleaning mixture from the collected vapor.

A further object of the present invention is to provide an apparatus for collecting condensed cleaning mixture for reuse in the system for reducing oxide which has formed on the surface of the cast bar and rod.

It is also an object of the present invention to provide a closed loop apparatus for reaching oxide which has formed on the surface of cast bar and rod which eliminates emissions of organic reducing agents into the atmosphere.

The principal feature of the present invention the is provision of an improved approach to the control of organic emissions during treatment of continuously cast and rolled rod and bar with an organic reducing solution for the purpose of removing surface oxides which form on the rod and bar during casting and rolling. Presently the control of organic emissions is only marginally effective and is not cost effective. In accordance with the present invention, a method and apparatus are provided for recovering organic emissions produced during the continuous in-line removal of oxides which form on the surface of copper bar and rod during casting as the bar emerges hot from a continuous casting machine, and rolling, as it passes through a rolling mill where it is hot worked to form rod.

Yet another feature of the present invention is the provision of a means for continuously collecting organic vapors at emission points and conveying the collected vapors away from the emission points under ambient conditions.

Another important feature of the present invention is the provisions of means for raising the temperature and pressure of the collected vapors above the ambient conditions for the system.

Another feature of the present invention is the provision of means for lowering the temperature of the collected vapor to a temperature below the temperature at which the collected vapors will condense to form a liquid without lowering the system pressure and collecting a condensate.

An additional feature of the present invention is the provision of means for separating condensate suspended in a residual vapor phase from that vapor phase, combining the separated condensate with previously collected condensate and returning the collected condensate to the reservoir of cleaning mixture for reuse within the system.

One advantage of the present invention is that increasing the vapor pressure of the collected vapors provides a more cost effective method and apparatus for recovering vapor phase organic reducing agents that are used in liquid form to deoxidize and cool copper rod as it is being cooled.

Another related advantage of the present invention is the substantial elimination of organic emissions which occur during continuous casting and rolling of copper. The method and apparatus of the present invention when used correctly recover about 78% more emissions than does the prior art system. The total recovery rate of the present invention is about 82 percent with the prior art methods of recovery only from 4 percent of all emmissions.

In accordance with these and other objects, features, and advantages there is provided, an improved method and apparatus for continuously removing oxides which form on the surface of copper bar wire and rod as the bar emerges hot from a casting machine and rolling mill where it is hot worked to form rod. The method comprising the steps of providing a source of aqueous based non-acid liquid cooling and cleaning mixture at a pH above 7.0; contacting the rod and bar with the cooling and cleaning mixture in at least one treatment gone downstream of the casting machine in which the cast bar and rod are kept in continuous contact with the cleaning mixture in both its liquid and vapor phases so that oxide on the surface of the bar and rod is reduced as the temperature of the bar and rod is lowered; continuously recirculating the liquid cleaning mixture; continuously monitoring and adjusting the pH of the cleaning mixture; collecting cleaning mixture vapors away from the emission points at ambient conditions of temperature and pressure; raising the temperature and pressure of the collected vapor above the ambient temperature and pressure of the system; lowering the temperature of the collected vapor to a temperature below the temperature at which the vapor will condense and form liquid without lowering the system pressure; and separating condensed liquid phase cleaning mixture from a vapor phase of the cleaning mixture and returning the collected liquid to the source of aqueous base cooling and cleaning mixture.

In accordance with the present invention the method further comprises the steps of raising the temperature and pressure of the collected vapor above ambient temperature and pressure of the system by increasing the velocity of the collected vapors to a selected velocity; the cooling collected vapors to a temperature at which liquid will form in the collected vapors while maintaining the velocity of the collected vapors at the selected velocity; and decreasing the velocity of the cooled vapor to a temperature at which liquid droplets will separate from any remaining vapor while maintaining the system pressure above the ambient pressure of the system.

In accordance with the present invention, the method further comprises the additional step of conveying any remaining vapor to a furnace and causing the remaining vapor to be completely oxidized.

The present invention also comprises apparatus for continuously removing oxides which are formed on the surface of copper bar and rod during casting and rolling as the bar emerges hot from a continuous casting machine and passes through a rolling mill when it is hot formed into rod comprising: a source of aqueous base non-acid liquid cooling and cleaning mixture at a pH in excess of 7.0; at least one treatment zone downstream of the casting machine for simultaneously receiving the cast bar and rod and the liquid cooling and cleaning mixture so that the cast bar and rod are kept in continuous contact with the cooling and cleaning mixture in both its liquid and vapor phases as the rod and bar pass through the treatment zone; means for continuously recirculating the cleaning mixture between its source and the treatment zone; means for monitoring and adjusting the pH of the cleaning mixture; means for collecting cleaning mixture vapors at emission points and means for conveying the collected vapor away from the emission points under conditions of ambient temperature and pressure; means for lowering the temperature of the collected vapor to a temperature below the temperature at which the vapor will condense to form liquid droplets without lowering the system pressure; and means for separating condensed liquid phase cleaning mixture from the remaining vapor.

In the present invention the means for increasing the temperature and pressure of the collected vapor comprises a blower which increases the velocity of the collected vapor; a heat exchanger for lowering the temperature of the collected vapor to a temperature below that at which liquid droplets will form; a means for reducing the velocity of the vapor so that the liquid droplets formed therein will separate and be collected; and a means for connecting the blower, the heat exchanger and the velocity reduction means so that they can function in concert.

In accordance with the present invention the apparatus comprises the additional means for collecting the liquid formed when the vapor is condensed in the heat exchanger, with the collecting means being connected to the source of aqueous cleaning mixture.

In accordance with the present invention the apparatus also comprises a secondary collecting means for collecting liquid which separates from the vapor when the velocity is decreased and a means for connecting the secondary collecting means to the reservoir which contains aqueous based cooling and clearing mixture.

BRIEF DESCRIPTION OF THE DRAWINGS

These and other objects features and advantages of the present invention will become more readily apparent as the description proceeds with the following more particular description of the preferred embodiment of the present invention which is illustrated in the accompanying drawings.

FIG. 1 is a schematic representation of a prior art method and apparatus for recovering organic emissions produced during the casting and rolling of copper rod.

FIG. 2 is a schematic representation of the apparatus and method of the present invention.

BEST MODE OF CARRYING OUT THE INVENTION

FIG. 1 schematically depicts a continuous casting system 10 wherein molten metal is formed into cast bar 12 in casting machine 11. The bar is rolled in rolling mill 13 which reduces the cross-sectional area of the bar and at the same time increases its length to form cast rod 14. The cast rod 14 is thereafter treated with a non-acid (organic) cooling and cleaning mixture of the same composition used in the present invention. The cast bar and rod 14 produced by rolling the cast bar are sequentially passed from rolling mill 13 into a treating zone represented by reference numerals 15–17. The next treatment zone, represented by numerals 17–19, further processes rod 14. The following treatment zone, represented by numerals 19–21, receives rod 14 for still further processing. Thereafter, rod 14 is optionally rinsed and/or waxed in apparatus 21 and directed to pinch rolls 22, rod quide mechanism 23, and coiler 24. Between treatment zones 15–17 and 17–19, a pressurized spray treatment is included.

As the rod 14 moves towards coiler 24, treating solution from tank 30 is continuously recirculated through the system 10. Treating solution is pumped from tank 30 via conduit 32 by pump 31 to water cooled heat exchanger 33 via conduit 34. The treating solution is directed through conduit 35 to each of the treating zones 15–17, 17–19, 19–21 via conduits 36–39, respectively. Return conduits 40, 41, 42 carry the treating solution back to tank 30 for further recirculation.

Vapors emitted during the reduction of the copper oxide are collected from rolling mill 13 and from treating zones 15–17, 17–19, 19–21 and from return conduits 40, 41, 42 and from tank 30. Vapor from rolling mill 13 are carried by conduit 502; vapors from treating zones 15–17, 17–19, 19–21 are carried by conduits 503, 505, 506; vapors from return conduits 40, 41, 42 are carried by conduits 507, 508, 509; and vapors from tank 30 are carried by conduit 510. Conduits 502, 503, 504, 505, 506, 507, 508, 509, 510 cooperate with conduit 501 which carries the vapors to condenser 500 where they are condensed to their liquid state. The reclaimed cleaning liquid is carried by conduit 529 to tank 530. Treating solution is pumped from tank 530 via conduit 532 by pump 531 to water cooled heat exchanger 533 via conduit 534. The treating solution is then directed to rolling mill 13 via conduit 535 where rolled copper product is treated. Treating solution is then returned to tank 530 via conduit 511 for reuse.

The continuous casting and rolling system described in FIG. 1 and discussed above represented an improvement over what had been the common practice within the industry. However, the system described in FIG. 1 is not an economical system to operate because recovery rates are low.

FIG. 2 is a schematic representation of an improved system for deoxidizing the surface of rod and bar as it is being cast and rolled. Because the rolling apparatus used with the present invention has not changed and an understanding of it is not considered necessary for an understanding of the present invention it has not been shown in FIG. 2. FIG. 2 deals specifically with the apparatus and method used to recover cleaning mixture vapors which escape to the atmosphere when prior art methods and apparatus are used. Referring now to FIG. 2 there is depicted an organic reducing agent recovery system 20. Recovery system 20 collects vapor emissions from the casting and rolling system (not shown) at emission points 21, **21*a*, 21*b*, 21*c*, 21*d*, and 21*e* which are points at which prior art continuous casting and rolling systems suffered evaporative loss of organic cooling and cleaning mixture. Recovered cooling and cleaning mixture vapors are carried away from emission points 21, 21*a*, 21*b*, 21*c*, 21*d*, and 21*e* through stainless steel pipes 22, 22*a*, 22*b*, 22*c*, 22*d* and 22*e* at several different velocities none of which is more than about 1350 fpm. The velocity of collected cleaning mixture vapors being conveyed away from emission points air wipe 21*d* at about 950 fpm. Vapors being carried away from cleaning mixture tank vent 21*c* are flowing at a velocity of about 1350 fpm. Vapors recovered at Hoffman filters 21 and 21*b*, are recovered from evaporative losses to the rolling coolant and lubricant tanks 21*a* and 21*b***, are carried away from these emission points at a velocity from about 1200 to about 1350 fpm.

Vapors collected at rolling mill hood 21*e* are conveyed at a velocity of about 1200 fpm. All vapors collected are consolidated in blower delivery pipe 22*e* and delivered to centrifugal blower 24 where the temperature and pressure of the collected vapors are raised so that the temperature of the pipe 22*f* collected vapors increases to as much as 176.5 F immediately before the vapors enter the heat exchanger unit 26 where the collected vapors are kept at an elevated pressure of up to 1.4 atmospheres and the temperature is lowered to a temperature less than the temperature at which droplets of vapor form thereby removing a fraction of the recovered vapor from the vapor stream. Some of the droplets formed in the heat exchanger 26 remain suspended in the vapor stream because of their small size and because of the velocity of the vapor stream The temperature of the vapor stream entering the heat exchanger 26 is about 176.5 F. As the vapor stream exits heat exchanger 26 the temperature of the vapor stream has been lowered to about 55 F. The velocity of the vapor stream entering and exiting the heat exchanger 26 is from about 1700 to about 1800 fpm which results in a system pressure of from about 16 psi to about 20 psi. The velocity of the vapor stream inside heat exchanger 26 is high enough through heat exchanger 26 so that the efficiency of the unit is greater. Heat exchanger 26 is of the circulating chilled water type which uses 40 F chilled water to lower the vapor temperature from about 176.5 F to about 55 F.

After leaving heat exchanger 26 the vapor/liquid suspension travels through pipe 22*f* to condensing tower 27 where the velocity of the vapor/liquid suspension is decreased to about 235 fpm thereby causing the liquid droplets suspended in the vapor stream to separate from the vapor stream and be collected for reuse in the cooling and cleaning process. Liquid collected at this point is transferred to tank 21*a* through pipe 22*g*. This two step cooling and condensing process results in the cooling and cleaning mixture collected as a vapor at emission points 21,21*e*, 21*a*, 21*b*, 21*c*, and 21*d*. Residual vapor exits condenser 27 through pipe 22*h* at a velocity of about 2600 fpm and is injected in furnace 28 where any remaining organic material is completely oxidized.

Although the invention has been discussed and described with primary emphasis on one embodiment, it should be obvious that adaptation and modifications can be made without departing from the spirit and scope of the invention.

What is claimed is:

1. Apparatus for continuously reducing oxides which form on the surface of copper bar and rod during casting as the bar emerges hot from a continuous casting machine and passes through a rolling mill where it is hot worked to form rod, comprising:

(a) a source of aqueous base non-acid liquid cooling and cleaning mixture at a pH in excess of 7;

(b) at least one treatment zone downstream of said casting machine comprising an elongated open ended conduit for simultaneously receiving the cast bar and rod and the liquid cooling and cleaning mixture whereby the cast bar and rod are kept in continuous contact with the cleaning mixture in both its liquid and vapor phases as the bar and rod pass through the treatment zone and oxide on the surface of the rod and bar are reduced as the temperature of the bar and rod is lowered;

(c) means for continuously recirculating the liquid cleaning mixture;

(d) means for monitoring and adjusting the pH of the liquid cleaning mixture;

(e) means for collecting cleaning mixture vapors at emission points and conveying the collected vapor from the emission points under ambient conditions;

(f) blower means for increasing the velocity of the collected vapors in combination with, heat exchange means for lowering the temperature of the collected vapors to a temperature at which liquid will form in the collected vapors; means for decreasing the velocity of the collected vapors to a velocity at which the liquid droplets will separate from any remaining vapor; and means for connecting said blower to said heat exchange means and said heat exchange means to said vapor velocity reduction means;

(g) means for lowering the temperature of the collected vapor to a temperature below the temperature at which the collected vapors will condense and form a liquid without lowering the system pressure; and (h) means for separating condensed liquid phase cleaning mixture from a vapor phase of the cleaning mixture and returning the collected liquid to the aqueous base non-acid liquid cooling and cleaning mixture.

2. The apparatus of claim 1 further including means of collecting condensed liquid and conveying the collected liquid to the source of aqueous working and cleaning mixture.

3. The apparatus of claim 1 further including means for collecting the liquid separated from the vapor phase of the cooling and cleaning mixture and transferring the collected liquid to the source of liquid cooling and cleaning mixture.

4. A method of continuously reducing oxides which forms on the surface of copper bar and rod during casting and rolling as the bar emerges hot from a continuous casting machine and passes through a rolling mill where it is hot worked to form rod, comprising the steps of:

(a) providing a source of aqueous base non-acid liquid cooling and cleaning mixture at a pH greater than 7.0;

(b) continuously contacting the rod and bar with the cooling and cleaning mixture in at least one treatment zone downstream of the casting machine wherein the cast bar and rod are kept in continuous contact with the cleaning mixture in both its liquid and vapor phases as the bar and rod pass through the treatment zone whereby oxide on the surface of the bar and rod is reduced as the temperature of the bar and rod is lowered;

(c) continuously recirculating the liquid cleaning mixture for reuse;

(d) continuously monitoring and adjusting the pH of the liquid cleaning mixture;

(e) collecting cleaning mixture vapors at emission points and conveying the collected vapor away from the emission points at ambient conditions of temperature and pressure;

(f) increasing the velocity of the collected vapors to a selected velocity; cooling the collected vapors to a temperature at which liquid will form in the collected vapors while maintaining a velocity sufficient to retain turbulent flow of the vapor during cooling and decreasing the velocity of the cooled collected vapors to a velocity at which liquid droplets will separate from any remaining vapor while maintaining the system pressure above the ambient pressure of the system;

(g) lowering the temperature of the collected vapor to a temperature below the temperature at which the vapor will condense and form liquid without lowering the system pressure; and (h) separating condensed liquid phase cleaning mixture from a vapor phase of the cleaning mixture and returning the collected liquid to the source of aqueous base cooling and cleaning mixture.

5. The method of claim 4 further including the step collecting the liquid formed in step (g) and conveying the collected liquid to the source of aqueous cooling and cleaning mixture.

6. The method of claim 4 further including the step of collecting the liquid separated from the vapor phase of the collected vapor and conveying the collected liquid to the source of liquid cooling and cleaning mixture.

7. The method of claim 4 including the additional steps of conveying the remaining collected vapor to a furnace and causing he remaining vapor to be completely oxidized.

* * * * *